US005507656A

United States Patent [19]

Ales

[11] Patent Number: 5,507,656

[45] Date of Patent: Apr. 16, 1996

[54] ELECTRICAL MALE PLUG LOCK

[76] Inventor: Matthew W. Ales, Rte. 2, Box 339V4, Amherst, Va. 24521

[21] Appl. No.: 328,781

[22] Filed: Oct. 28, 1994

[51] Int. Cl.[6] ..... H01R 13/44

[52] U.S. Cl. ..... 439/133; 439/134

[58] Field of Search ..... 439/133, 134

[56] References Cited

U.S. PATENT DOCUMENTS

| | | | |
|---|---|---|---|
| 2,664,734 | 1/1954 | McEneaney | 439/134 OR |
| 2,733,416 | 1/1956 | Evalt | 439/134 OR |
| 4,025,140 | 5/1977 | Matys . | |
| 4,957,446 | 9/1990 | Belsky | 439/134 |
| 5,055,057 | 10/1991 | Boyer | 439/134 |
| 5,176,527 | 1/1993 | Herbert | 439/134 |
| 5,277,600 | 1/1994 | Meixler | 439/134 |

*Primary Examiner*—P. Austin Bradley
*Assistant Examiner*—Daniel Wittels
*Attorney, Agent, or Firm*—David L. Baker; Rhodes & Ascolillo

[57] ABSTRACT

The invention is a lock for male electrical connectors used with appliances and power equipment and consists of a housing with receiving slots for the connector prongs and a U-shaped spring in the housing containing nibs that engage the apertures on the connector prongs. A spring biased plunger engages the arms and cause them to release the prongs when depressed. Cooperating holes through the housing and the plunger allow a lock to pass through and disable the plunger. The spring biasing the plunger is selectibly changeable for situations where a stronger spring would negate the use of a lock. The housing is sufficiently thin that a three conductor plug could be locked without interference from the ground prong.

6 Claims, 4 Drawing Sheets

ELECTRICAL MALE PLUG LOCK

BACKGROUND OF THE INVENTION

1. Field of the Invention

This invention relates generally to electrical male plugs and in particular to an apparatus for locking electrical male plugs and rendering them temporarily unusable.

2. Description of the Prior Art

Numerous conditions exist where it is imperative that electrical equipment and devices be controlled and only operated at appropriate times for appropriate reasons by appropriate persons. The gambit ranges from the industrial shop equipment to the teenagers' television set. This invention covers this range of electrical devices that are powered by inserting a male electrical plug into female electrical outlet. There are other types and styles of electrical lockout systems for machines and devices that are wired directly to the source of current, however the invention described and claimed herein relates only to those that in effect are plugged in to the wall.

The problem of unauthorized use of electrical devices is not new and attempts have been made in the past for a simple, reliable and effective means to control unauthorized use, thus far the devices proposed fall short of the mark in one fashion or another. For example, U.S. Pat. No. 4,025,140 issued May 24, 1977 to Matys discloses a male plug locking device that uses a housing to enclose the conductors and includes a threaded lock screw to engage the aperture on one conductor. The head of the screw is of a special design and therefore requires a key to match that design to move the screw into and out of the locking position. U.S. Pat. No. 4,957,446 issued Sep. 18, 1990 to Belsky shows another lock out device that utilizes a housing to cover the electrical connectors and then provides a flexible strap that passes through holes in the housing and the connectors. The reusability of the strap is a question in this device. Another U.S. Pat. No. 5,055,057 issued Oct. 8, 1991 to Boyer who discloses a housing adapted to receive a pair of electrical connector prongs and automatically engage the holes in the prongs. The housing remains in place, locking the plug until a key for the housing is inserted and turned withdrawing the locking studs from the connector prongs thereby separating the housing from the prongs. A U.S. Patent granted to Herbert No. 5,176,527 on Jan. 5, 1993 shows a block housing with at least one channel for receiving a projecting portion of an electrical connector. A threaded bore intersects the channel and contains a locking pin that engages the projecting portion of the connector and further includes a second bore intersecting the threaded bore and adapted to receive a means in the nature of a lock that would prevent access to the locking pin. In U.S. Pat. No. 5,277,600 issued Jan. 11, 1994 to Meixler a safety lock is disclosed which includes a plastic block adapted to receive an electrical plug. Holes aligned to accept an ordinary bolt that would pass through the block and the electrical connectors and be locked in place preventing use of the plug.

The devices shown and known to the Applicant all require locks, keys or tools to operate. The one device that does not, is destroyed in the process of removal or uses a lock to avoid destroying the strap lock. The prior art fails to show a male plug lock that will secure the connectors and render the plug unusable with or without a separate lock or key depending upon the application.

SUMMARY OF THE INVENTION

The invention is directed to an electrical plug lock that will temporarily disable the plug from being used to connect electrical equipment and devices to an electrical power outlet. The invention consists of a relatively flat rectangular housing with four walls, a back panel and a cover. One end wall of the housing contains a pair of parallel slots adapted to receive the prongs of a conventional electrical plug. The housing is sufficiently thin that if the plug contained a third ground prong it would pass over the housing and not interfere with the operation of the lock. Within the housing is a flat metal U-shaped spring containing prong engaging nibs at the end of each arm. A spring biased plunger passes through the base of the flat spring and through the wall of the housing and disengages the nibs from the apertures in the prongs when depressed. Holes in the cover, plunger and the back panel are normally in alignment and permit the use of a conventional locking device to prevent the plunger from being depressed and the housing removed.

It is therefore an object of the invention to provide a new and improved electrical male plug lock.

It is another object of the invention to provide a new and improved electrical plug lock that is simple to operate.

It is a further object of the invention to provide a new and improved electrical plug lock that will operate with or without additional locking means.

It is still another object of the invention to provide a new and improved electrical plug lock that may be used with a variety of two and three prong plugs.

It is still a further object of the invention to provide a new and improved electrical plug lock which may be easily and efficiently manufactured and marketed.

It is another object of the invention to provide a new and improved electrical plug lock which is of durable and reliable construction.

These, together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawing wherein.

DETAILED DESCRIPTION OF A PREFERRED EMBODIMENT

Figure 1:
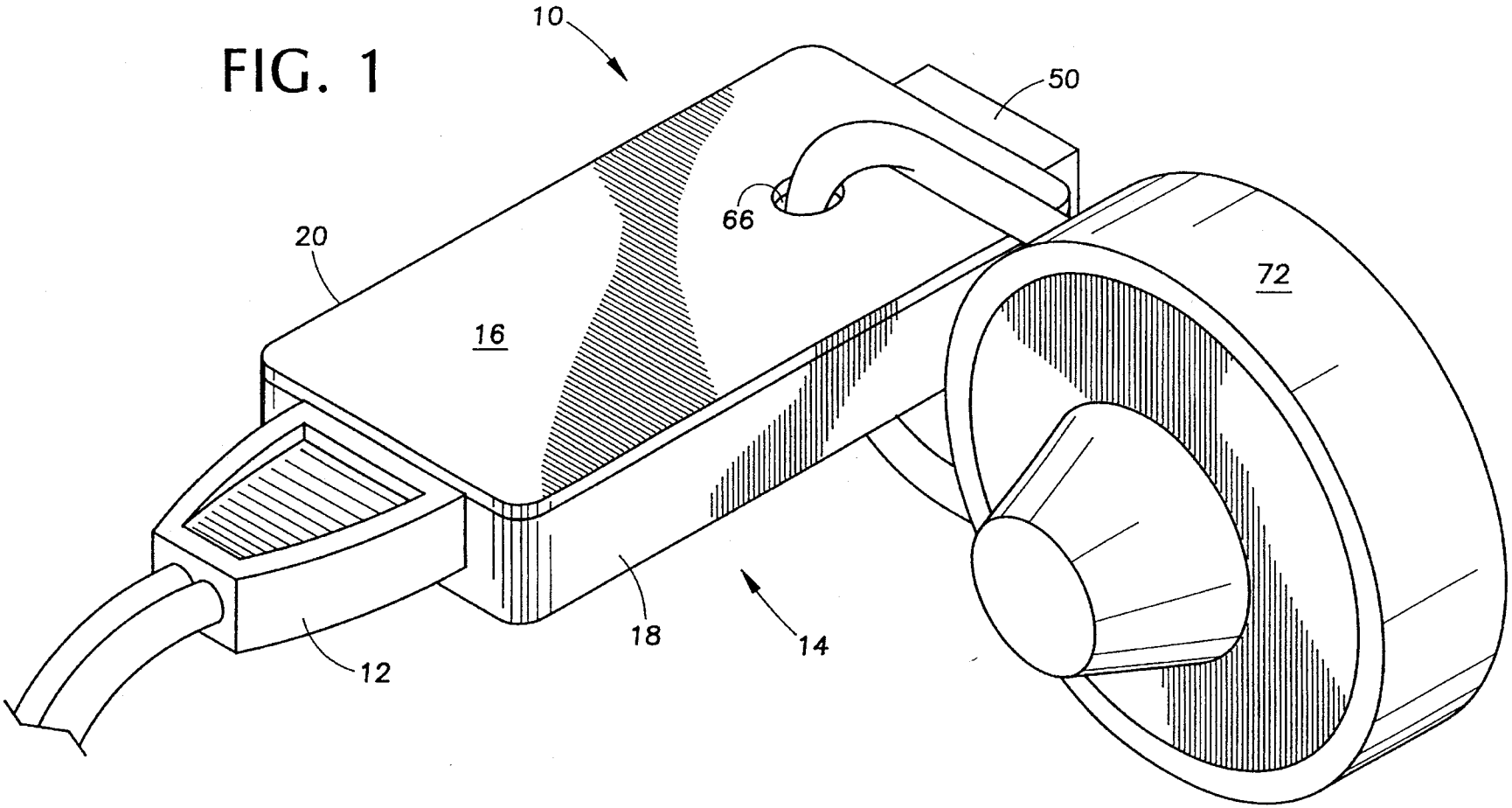
FIG. 1 is a perspective view of the invention.
Figure 2:
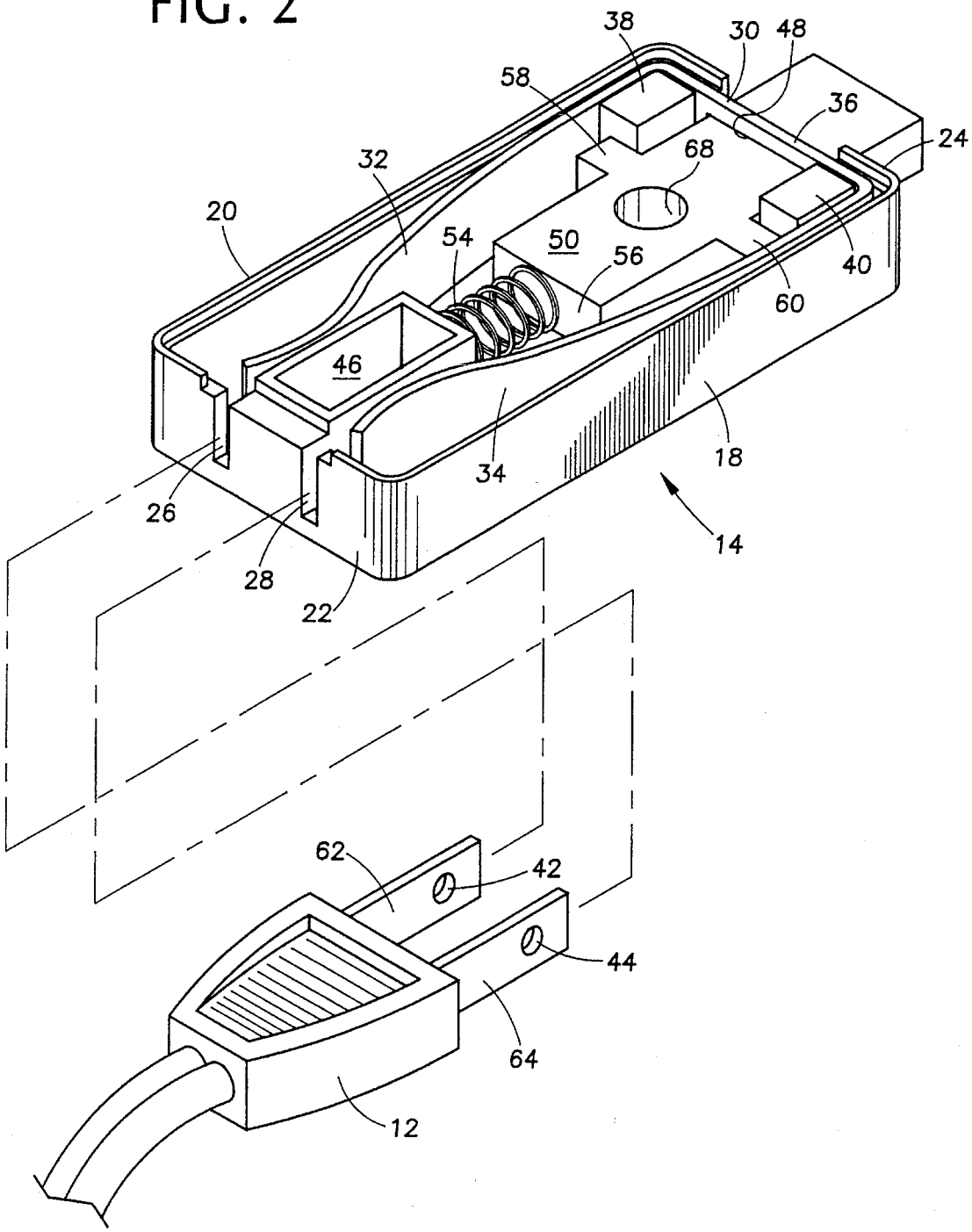
FIG. 2 is a perspective view of the invention with the cover removed.
Figure 3:
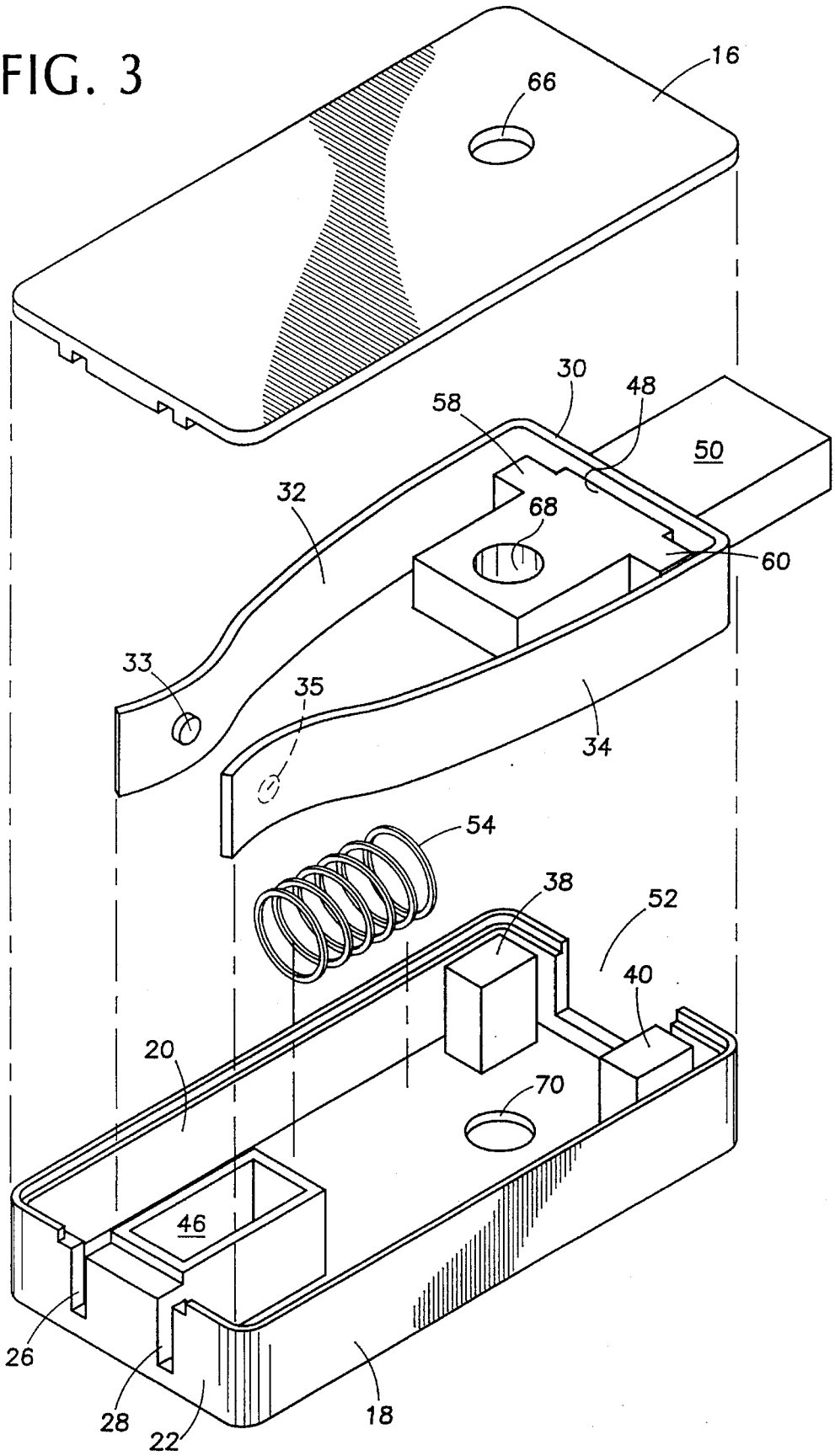
FIG. 3 is an exploded view of the invention.

Referring now to FIGS. 1, 2 and 3, the electrical plug lock of the invention is shown generally at 10 and consists of a housing adapted to receive two prongs of an electrical male plug 12. The housing is formed of plastic and is in two pieces, a body 14 and a cover 16. The body includes two side walls 18,20 and two end walls 22,24. One end wall contains two rectangular apertures 26,28 that are of sufficient size and dimension to accept the prongs of an electrical plug including those with an enlarged polarization prong. A flat U-shaped metal spring 30 is contained within the housing with arms 32,34 following the inside perimeter of the housing for approximately one third the distance between the end walls. The base 36 of the spring is held juxtaposed to the end wall distal from the rectangular aperture containing end wall by a pair of studs 38,40 extending from the back panel of the housing. At a point approximately one third the total distance between the end walls the metal spring leaves the perimeter of the housing and curves gradually toward the longitudinal center line of the housing. At a point approximately two thirds the total distance and before the arms of the spring come into contact, the arms contain a relatively short radius curve away from the center line of the housing. On the arc of the curve for each arm is mounted an inward facing nib 33,35 sized to engage the apertures 42,44 of a male electrical plug. The arms are separated by a spacer block 46 located between the plug receiving apertures in the housing wall. An aperture 48 in the base of the spring allows a plunger 50 to pass through and extend through an aperture 52 in the housing end wall 24. The plunger is biased away from the prong receiving end of the housing by a coil spring 54 positioned between the spacer 46 and the plunger base 56. Arms 58 and 60 on the plunger extend laterally within the housing and engage the arms 32,34 of the flat spring.

Figure 4:
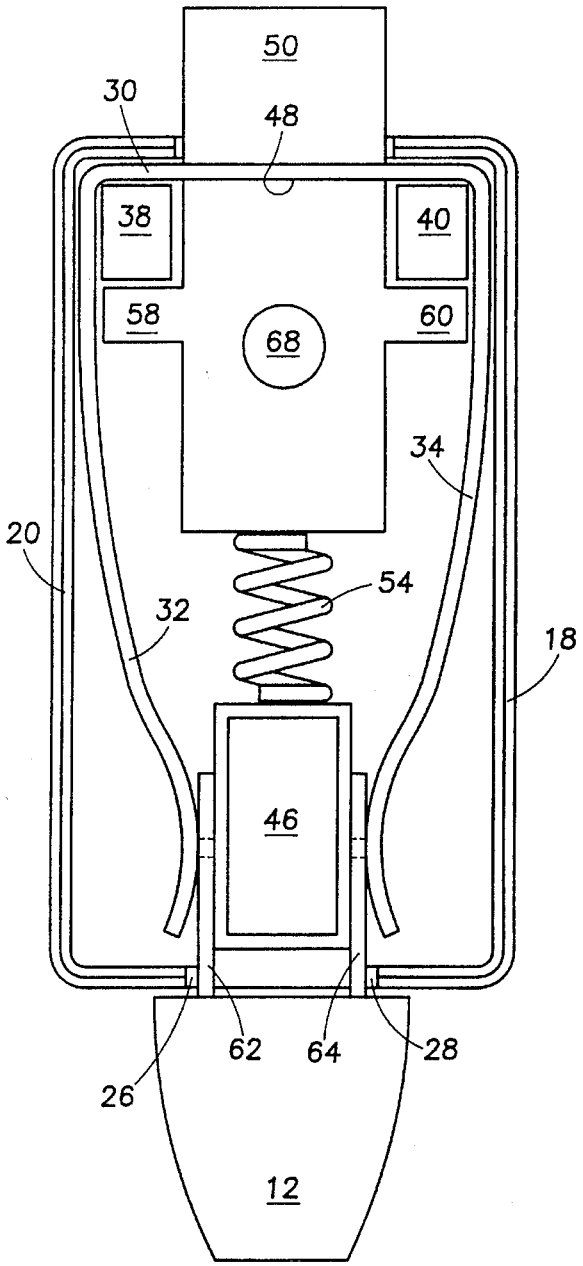
FIG. 4 is a top plan view of the invention engaging an electrical plug.
Figure 5:
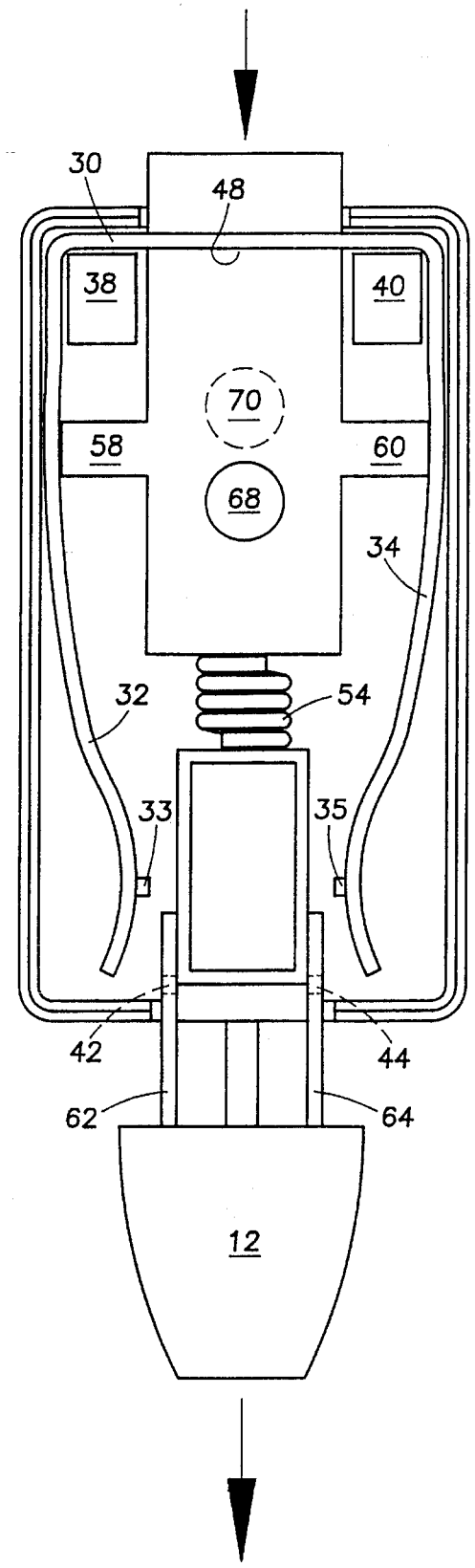
FIG. 5 is a top plan view of the invention with the plunger depressed.

Concerning FIGS. 4 and 5, in operation, the prongs 62,64 of the plug 12 enter apertures 26,28 of the housing and engage the nibs 33,35 on flat spring arms 32,34 which are biased toward the center line of the housing. The prongs 62,64 of plug 12 are released by depressing the plunger 50 against the bias of coil spring 54 which causes the arms 32,34 of flat spring 30 to separate withdrawing the nibs 33,35 from the apertures 42,44 in the prongs.

Controlling the bias force of coil 54 spring will directly effect the force required to depress plunger 50, the more spring bias will require more force to depress the plunger, thereby allowing the lock to be adjusted to prevent young children from successfully disengaging the lock from the plug without the need for a separate locking device. In addition, by aligning holes 66 in the cover, 68 in the plunger and 70 in the back panel of the housing a conventional locking device 72 may be passed through and restrict movement of the plunger and prevent release of the prongs.

It should understood, of course, that the foregoing disclosure relates to only a preferred embodiment of the invention and that numerous modifications or alterations may be made therein without departing from the spirit and scope of the invention as set forth in the appended claims.

What is claimed is:

1. An electrical male plug lock for plugs with two or more prongs where at least each of two parallel blade shaped prongs have transverse apertures, the invention comprising: a rectilinear housing including, a back panel, two side walls and two end walls and a removable cover panel parallel to the back panel; a pair of rectilinear receiving apertures in one end wall; a spacer block within the housing between and proximate to the receiving apertures; a flat U-shaped spring having a base and two parallel arms mounted within the housing, said base and approximately one third of each adjacent arm in juxtaposition with the interior wall perimeter of the housing, where the remaining two thirds of each arm curves away from the wall perimeter toward the longitudinal center line of the housing and each arm rests on opposed sides of the said spacer block; aperture means in the base of the U-shaped spring; congruent aperture means in the housing end wall matching the aperture in the U-shaped spring; plunger means in the housing adapted to move along the longitudinal axis of the housing and further adapted to extend through apertures in the spring and housing for operation; a coil spring within the housing positioned between the spacer block and the end of the plunger for biasing the plunger in the direction of said aperture, and arms on said plunger extending transversely to the longitudinal axis of the housing and engaging each arm of the U-shaped spring, whereby movement of the plunger against the bias of the coil spring will cause the arms of the flat spring to move away from the spacer block and release the prongs of an electrical plug engaged through the receiving apertures.

2. An electrical male plug lock according to claim 1 further including: inwardly facing nibs positioned on each flat spring arm proximate the end of the arm and in and oriented to cause each to rest on the spacer block when not engaging the apertures in the parallel blades of a male electrical plug.

3. An electrical male plug lock according to claim 2 further including: complementary apertures in the cover panel, plunger and back panel for receiving a locking device and disabling the plunger.

4. An electrical male plug lock according to claim 3 wherein: the coil spring providing bias force for the plunger is changeable for selected applications.

5. An electrical male plug lock according to claim 1 wherein: the flat spring is held in position against the perimeter of the interior wall by a pair of studs secured to the back panel and extending in the direction of the cover.

6. An electrical male plug lock according to claim 1 wherein: the walls of the housing are sufficiently restricted in height to allow the blades of a conventional three conductor plug to enter the receiving slots without interference from the ground prong.

* * * * *